United States Patent [19]

Dierick et al.

[11] Patent Number: 4,857,029

[45] Date of Patent: Aug. 15, 1989

[54] BALLOON STORAGE AND INFLATION ASSEMBLY

[75] Inventors: Tony F. J. Dierick, Zwijnaarde; Nicholas J. Kite, Antwerp; Michael J. Moran, Kapellen, all of Belgium

[73] Assignee: Enviro-Spray Systems, Inc., Hoboken, N.J.

[21] Appl. No.: 70,365

[22] Filed: Jul. 7, 1987

[51] Int. Cl.[4] ..... A63H 3/06; G09F 1/10; B63C 9/12; B65D 77/00

[52] U.S. Cl. ..... 446/220; 40/214; 40/124.1; 441/100; 206/216; 206/583

[58] Field of Search ..... 206/216, 583, 463, 221; 40/214, 215, 217, 124.1; 441/100, 101, 99, 98, 88; 446/220, 221–226

[56] References Cited

U.S. PATENT DOCUMENTS

| | | | |
|---|---|---|---|
| 1,490,295 | 4/1924 | Stephens | 40/124.1 X |
| 2,097,542 | 11/1937 | Wallin | 441/100 |
| 2,149,616 | 3/1939 | McGuire | 441/100 |
| 2,516,552 | 7/1950 | Clark et al. | 546/220 |
| 2,698,496 | 1/1955 | Miller | 446/226 |
| 3,173,540 | 3/1965 | Lapides | 206/463 |
| 3,424,380 | 1/1969 | Curran | 206/463 X |
| 3,451,882 | 6/1969 | Propoggio | 40/214 X |
| 3,798,806 | 3/1974 | Sanford | 40/124.1 X |
| 4,360,131 | 11/1982 | Reyner | 222/386.5 |
| 4,376,500 | 3/1983 | Banks et al. | 222/399 |
| 4,478,044 | 10/1984 | Magid | 222/394 |

*Primary Examiner*—Robert A. Hafer
*Assistant Examiner*—D. Neal Muir
*Attorney, Agent, or Firm*—Kenyon & Kenyon

[57] ABSTRACT

A balloon storage and inflation assembly comprises a circular inflatable balloon containing a pair of chemical reactants separated from one another, one of the reactants being held in a burstable container. The balloon is placed between two plates of a support structure, the burstable container and a portion of the balloon being disposed in a recess formed by two aligned openings in the plates. The support structure is further provided with a pair of doors hingedly secured to respective ones of the plates along edges of the openings. The doors are swung into the openings to compress the burstable container and to facilitate a rupture thereof upon the striking of one of the doors by a fist or other object.

22 Claims, 2 Drawing Sheets

BALLOON STORAGE AND INFLATION ASSEMBLY

BACKGROUND OF THE INVENTION

This invention relates to a balloon storage and inflation assembly More particularly, this invention relates to such an assembly having a balloon which is in a deflated storage state for purposes of transport and which carries at least one chemical substance which may be activated to generate a gas to inflate the balloon upon manipulation of the storage and inflation assembly It has long been known to dispose two chemical reactants, separated from one another, in a deflated inflatable container. For example, as described in U.S. Pat. No. 2,149,616 to McGuire, a tube of rubber contains an inner tube of a first chemical reactant in the form of a liquid and a quantity of a second chemical reactant in the form of a powder. The inner tube is provided with a mouth stopped with a cork. Upon a squeezing of the inner tube, the cork is forced out of the mouth of the inner tube, whereupon the liquid reactant emerges to mix with the powdered reactant to form a gas which inflates the outer tube.

It is also known to use different chemical reactants such as citric acid and sodium bicarbonate to generate a gas to expand an inflatable pouch. Such an automatic pouch inflation system may be used to dispense a flowable product from a container, as described in U.S. Pat. Nos. 4,360,131 to Reyner, 4,376,500 to Banks et al. and 4,478,044 to Magid.

Other U.S. patents describe other arrangements for automatically inflating balloon-like objects. U.S. Pat. No. 2,698,496 to Miller discloses a self-inflating stable plastic figure which is provided with a carbon dioxide capsule having a projecting hollow stem which is readily breakable upon the breaking of the capsule's stem, the released carbon dioxide rapidly expanding and causing the plastic figure to inflate automatically. U.S. Pat. No. 2,516,552 to Clark et al. is directed to a method of making inflatable toys wherein a pellet of carbon dioxide is placed between two sheets of thermoplastic material which are treated so as to simulate a desired figure. U.S. Pat. No. 2,097,542 to Wallin describes a self-inflating life belt provided with a burstable phial filled with concentrated sulfuric acid and placed in a solution of sodium bicarbonate. Upon rupture of the phial, the sulfuric acid mixes with the sodium bicarbonate solution to generate sufficient gas to inflate the life belt.

It has been proposed to use a gas-generating system to automatically inflate balloons for entertainment purposes. However, the shipping and handling of quantities of such self-inflating balloons may result in an undesired accidental inflation of the balloons, owing to unintentional rupturing of a container holding a compressed gas or a solution of one of two chemical reactants in the deflated balloon.

Such self-inflating balloons may advantageously be sold with newspapers, magazines, announcements and other publications. Such a distribution of the balloon requires that they are protected from accidental inflation when transported in stacks of newspapers, magazines or other publications.

An object of the present invention is to provide a balloon storage and inflation assembly wherein accidental or unintentional inflation is substantially reduced, if not entirely eliminated.

Another, more particular, object of the present invention is to provide such a balloon storage and inflation assembly which is easily and inexpensive to manufacture.

SUMMARY OF THE INVENTION

A balloon storage and inflation assembly comprises, in accordance with the present invention, a deflated sealed balloon, a gas generating mechanism including at least one chemical substance in said balloon for generating a gas to inflate said balloon, and a burstable container holding said chemical substance in a pre-activation state. The balloon storage and inflation assembly also comprises a storage component for preventing unintentional rupture of said container and thereby protecting said balloon from unintentional inflation during shipping and handling operations. The storage component includes a substantially rigid support structure and a recess in the support structure for receiving and at least partially enclosing the container and a portion of the balloon during the shipping and handling operations, thereby preventing accidental rupture of the container. The balloon storage and inflation assembly further comprises a member on the support structure for facilitating manual breakage of the container and concomitant inflation of the balloon.

Preferably, the gas generating mechanism includes a pair of chemical reactants in the balloon, the chemical substance constituting one of the chemical reactants. Upon rupture of the burstable container, the chemical reactants mix and generate a balloon inflating gas.

Pursuant to further features of the present invention, the support structure is a substantially planar throw-away structure and has an area of extent at least substantially coextensive with the deflated sealed balloon, while the rupture facilitating member takes the form of a plate swingably attached to the support structure and rotatable into the recess.

Pursuant to yet further features of the present invention, the support structure includes a first planar piece and a second planar piece hingedly secured to one another along respective edges, the recess taking the form of a first opening in the first planar piece and a second opening in the second planar piece, the first and the second opening being substantially coextensive and aligned with one another in a folded configuration of the first planar piece and the second planar piece. Preferably, the rupture facilitating plate member is attached to one of the first planar piece and the second planar piece along an edge of one of the first opening and the second opening. The balloon storage and inflation assembly may include an additional plate member hingedly secured to the other of the first planar piece and the second planar piece along an edge of the other of the first opening and the second opening, the two plate members cofunctioning to facilitate rupture of the burstable container at an appropriate time. The two plate members are advantageously attached to respective ones of the first planar piece and the second planar piece so that the plate members are swingable in opposite directions from the recess in the folded configuration of the support structure.

In a balloon storage and inflation assembly in accordance with the present invention, a balloon with a self-inflation mechanism activated by a manual rupture operation is positioned between two planar structural members so that a container holding a chemical reactant is disposed in a recess and thereby protected from accidental breakage when the balloon storage and inflation assembly is being transported, for example, in a stack of newspapers or magazines. To initiate the automatic inflation of the balloon, a user swings the hingedly mounted plate members towards the recess in the support structure and then, with the entire assembly supported on a horizontal surface, strikes the upwardly facing plate member with a fist or other object, thereby rupturing the container holding the chemical reactant (e.g., citric acid).

A balloon storage and inflation assembly in accordance with the present invention is inexpensive and easy to manufacture.

BRIEF DESCRIPTION OF THE DRAWING

FIG. 3 is a cross-sectional view of the balloon storage and inflation assembly of FIGS. 1 and 2 in a closed, transport or storage configuration.

DETAILED DESCRIPTION

Figure 1:
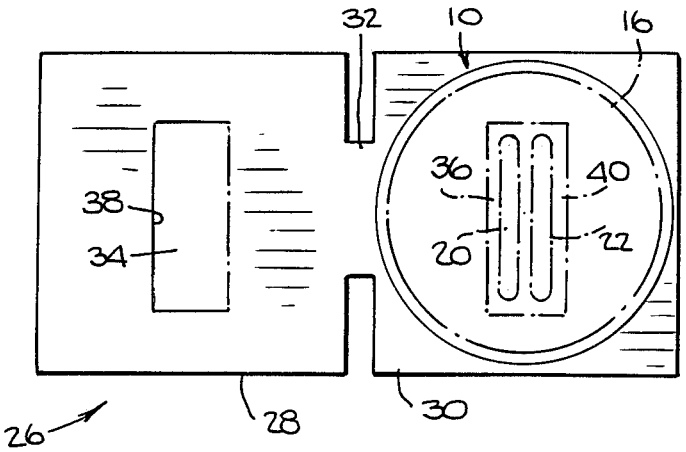
FIG. 1 is a plan view of a balloon storage and inflation assembly in accordance with the present invention, in an unfolded configuration.
Figure 2:
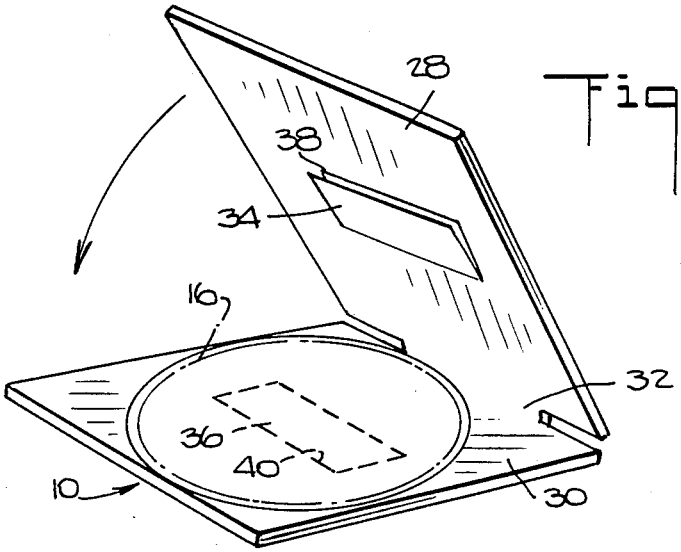
FIG. 2 is an isometric view of the balloon storage and inflation assembly of FIG. 1, in an open configuration.
Figure 4:
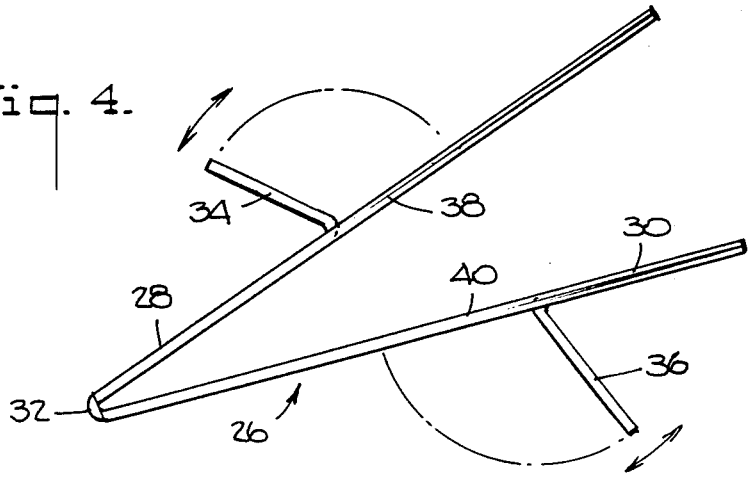
FIG. 4 is a side view of a support structure included in the balloon storage and inflation assembly of FIGS. 1–3.
Figure 4:
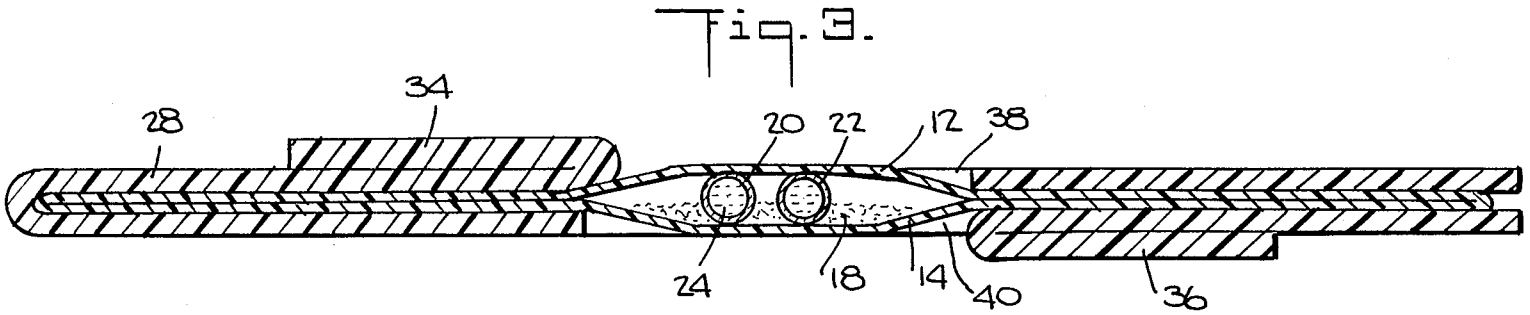

As illustrated in FIGS. 1 and 2, a balloon storage and inflation assembly in accordance with the present invention comprises an inflatable balloon 10, shown in a deflated state in the drawing. The balloon comprises two circular sheets 12 and 14 of elastic or non-elastic material heat welded to one another along a circular seam at a common periphery of the two circular sheets 12 and 14. Balloon 10 contains, in the preinflation or deflated state, a quantity of sodium bicarbonate 18 in powder form and one or two plastic tubes 20 and 22 which hold a solution of citric acid 24. The chemicals remain separated from one another in balloon 10 until an impact ruptures the citric acid tubes, whereupon the acid and soda react to produce carbon dioxide which inflates the balloon.

In order to protect the balloon from unintentional inflation and to enable mass distribution of the balloon exemplarily in newspapers or magazines, the balloon storage and inflation assembly further comprises a throw-away support structure 26 preferably comprising two square planar cardboard pieces or plates 28 and 30 connected to one another by a pivoting joint or hinge 32. The two plates have edges or sides with a length approximately equal to the diameter of circular plastic sheets 12 and 14.

During manufacture of the balloon storage and inflation assembly, the deflated balloon 10 is placed on an upper side of one of the two plates (e.g., plate 30 in FIG. 1), whereupon the other plate is pivoted into an aligned configuration with the first plate to form a sandwich comprising the two plates 28 and 30 and the deflated balloon 10 (see FIG. 3).

Each plate 28 and 30 is provided in a central region with a respective rectangular door or plate member 34 or 36 cut along three sides from the respective plate 28 or 30 and hinged along a fourth side thereto. Each plate 28 and 30 of the throw-away support structure 26 is therefore provided with a respective rectangular opening 38 or 40 approximately equal in size to the respective door 34 or 36 and defined along one edge by the respective door hinge.

Figure 5:
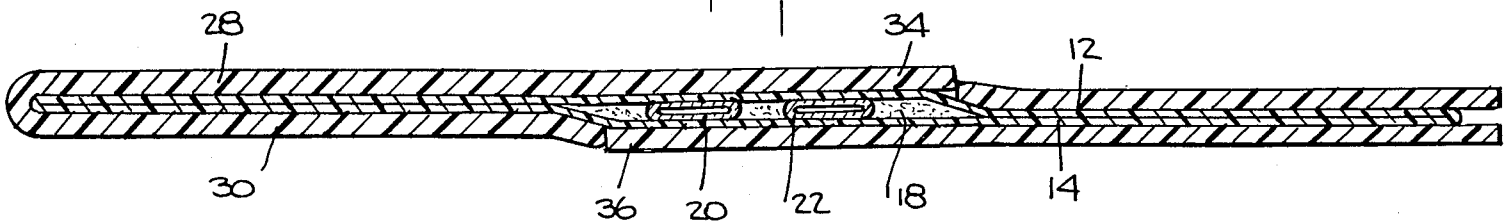
FIG. 5 is a cross-sectional view, similar to FIG. 3, of the balloon storage and inflation assembly of FIGS. 1–3, in an inflation-facilitating configuration.

Openings 38 and 40 in plates 28 and 30 are aligned and coextensive with one another upon a placement of the support structure 26 in a closed configuration, as depicted in FIGS. 3 and 5. In the closed, storage or transport configuration of the balloon assembly, illustrated in FIG. 3, citric acid bearing tubes 20 and 22, as well as a portion of each circular sheet 12 and 14, are disposed in a recess defined by openings 38 and 40. In addition, doors 34 and 36 are folded back upon respective plates 28 and 30 to lie on opposite sides of the common recess. In the storage configuration of the balloon storage and inflation assembly, tubes 20 and 22 are protected from excessive pressure such as that caused by stack of magazines, thereby preventing an untimely bursting of the citric acid tubes and concomitant inflation of the balloon. As illustrated in FIG. 3, throw-away support structure 26 also serves to position the chemical reactants and to hold them in place until the time of activation.

In order to rupture citric acid tubes 20 and 22 and thereby initiate the automatic self-inflation process, doors 34 and 36 are closed, as shown in FIG. 5, so that tubes 20 and 22 are squeezed between the doors. The assembly is placed on a flat horizontal surface and the upper door is struck (e.g, by a fist) to rupture or burst the tubes and thereby release the citric aid into contact with the sodium bicarbonate.

Although the invention has been described in terms of particular embodiments and applications, one of ordinary skill in the art, in light of this teaching, can generate additional embodiments and modifications without departing from the spirit of or exceeding the scope of the claimed invention. For example, the chemical reactants may be substances other than citric acid and sodium bicarbonate. In addition, the throw-away support structure may take a form other than that of two plates hingedly secured to one another and provided with respective pivotably connected doors. Accordingly, the descriptions and illustrations herein are proffered by way of example to facilitate comprehension of the invention and should not be construed to limit the scope thereof.

What is claimed is:

1. A balloon storage and inflation assembly comprising in combination:

a deflated sealed balloon;

gas generating means including at least one chemical substance in said balloon for generating a gas to inflate said balloon;

frangible means including, in said balloon, a burstable container holding said chemical substance in a preactivation state;

storage means for preventing unintentional rupture of said container and thereby protecting said balloon from unintentional inflation during shipping and handling operations, said storage means including a substantially rigid support structure, said storage means further including a recess in said support structure for receiving and at least partially enclosing said container and a portion of said toy balloon during said shipping and handling operations, thereby preventing accidental rupture of said burstable container; and said storage means further including rupture facilitating means on said support structure, angularly displaceable from said recess, for bursting said container and thereby inflating said balloon.

2. The assembly recited in claim 1 wherein said support structure is a substantially planar throw-away structure and has an area of extent at least substantially coextensive with said deflated sealed balloon.

3. The assembly recited in claim 1 wherein said gas generating means includes a pair of chemical reactants in said balloon, said chemical substance constituting one of said chemical reactants.

4. A balloon storage and inflation assembly comprising in combination:

a deflated sealed balloon;

gas generating means including at least one chemical substance in said balloon for generating a gas to inflate said balloon;

frangible means including in said balloon a burstable container holding said chemical substance in a pre-activation state;

storage means for preventing unintentional rupture of said container and thereby protecting said balloon from unintentional inflation during shipping and handling operations, said storage means including a substantially rigid, substantially planar throw-away structure having an area of extent at least substantially coextensive with said deflated sealed balloon, said storage means further including a recess in said support structure for receiving and at least partially enclosing said container and a portion of said balloon during said shipping and handling operations, thereby preventing accidental rupture of said container; and rupture facilitating means on said support structure for facilitating manual breakage of said container and concomitant inflation of said balloon, said facilitating means including a plate member swingably attached to said support structure and rotatable into said recess.

5. The assembly recited in claim 4 wherein said support structure includes a first planar piece and a second planar piece hingedly secured to one another along respective edges, said recess taking the form of a first opening in said first planar piece and a second opening in said second planar piece, said first and said second opening being substantially coextensive and aligned with one another in a folded configuration of said first planar piece and said second planar piece.

6. The assembly recited in claim 5 wherein said plate member is attached to one of said first planar piece and said second planar piece along an edge of one of said first opening and said second opening.

7. The assembly recited in claim 6 wherein said facilitating means further includes an additional plate member hingedly secured to the other of said first planar piece and said second planar piece along an edge of the other of said first opening and said second opening.

8. The assembly recited in claim 4 wherein said support structure is made of cardboard.

9. The assembly recited in claim 4 wherein said burstable container is in the form of a tube having a length smaller than a length dimension of said recess.

10. The assembly recited in claim 4 wherein said gas generating means includes a pair of chemical reactants in said balloon, said chemical substance constituting one of said reactants.

11. The assembly recited in claim 10 wherein said reactants include sodium bicarbonate and citric acid.

12. The assembly recited in claim 11 wherein said sodium bicarbonate is in powder form loosely disposed in said balloon and wherein said citric acid is held in said container.

13. A balloon storage and inflation assembly comprising in combination:

a deflated sealed balloon;

gas generating means including a pair of chemical reactants in said balloon for generating a gas to inflate said balloon;

frangible means including a burstable container holding at least one of said chemical reactants separated from the other of said chemical reactants;

storage means for preventing unintentional rupture of said container and thereby protecting said balloon from unintentional inflation during shipping and handling operations, said storage means including a substantially rigid, substantially planar throw-away structure having an area of extent at least substantially coextensive with said deflated sealed balloon, said storage means further including a recess in said support structure for receiving and at least partially enclosing said container and a portion of said balloon during said shipping and handling operations, thereby preventing accidental rupture of said container, said support structure including a first planar piece and a second planar piece hingedly secured to one another along respective edges, said recess taking the form of a first opening in said first planar piece and a second opening in said second planar piece, said first and said second opening being substantially coextensive and aligned with one another in a folded configuration of said first planar piece and said second planar piece, said plate member being attached to one of said first planar piece and said second planar piece along an edge of one of said first opening and said second opening; and rupture facilitating means on said support structure for facilitating manual breakage of said container and concomitant mixing of said chemical reactants, said facilitating means including a first plate member swingably attached to said support structure and rotatable into said recess, said facilitating means further including a second plate member hingedly secured to the other of said first planar piece and said second planar piece along an edge of the other of said first opening and said second opening, said first and said second plate member being attached to respective ones of said said first planar piece and said second planar piece so that the plate members are swingable in opposite directions from said recess in said folded configuration.

14. The assembly recited in claim 13 wherein said support structure is made of cardboard.

15. The assembly recited in claim 13 wherein said burstable container is in the form of a tube having a length smaller than a length dimension of said recess.

16. The assembly recited in claim 13 wherein said reactants include sodium bicarbonate and citric acid.

17. The assembly recited in claim 16 wherein said sodium bicarbonate is in powder form loosely disposed in said balloon and wherein said citric acid is held in said container.

18. A method for inflating a balloon, comprising the steps of:

providing a balloon storage and inflation assembly comprising (a) a deflated sealed balloon, (b) gas generating means incluidng a pair of chemical reactants in said balloon, (c) frangible means including a burstable container holding at least one of said chemical reactants separated from the other of said chemical reactants, (d) storage means for preventing unintentional rupture of said container and thereby protecting said balloon from unintentional inflation during shipping and handling operations, said storage means including a substantially rigid support structure, said storage means further including a recess in said support structure for receiving and at least partially enclosing said container and a portion of said balloon during said shipping and handling operations, thereby preventing accidental rupture of said container, and (e) rupture facilitating means on said support structure for facilitating manual breakage of said container and concomitant mixing of said chemical reactants;

manipulating said rupture facilitating means to shift same from a storage configuration to a breakage facilitating configuration in which a portion of said rupture facilitating means is in physical contact with said balloon in a region coextensive with said container; and striking said portion of said rupture facilitation means in said region with sufficient force to burst said container and thereby permit said one of said chemical reactants to come into contact with said other of said chemical reactants.

19. The method recited in claim 18, further comprising the step of shaking said balloon to accelerate mixing of said chemical reactants.

20. The method recited in claim 19, further comprising the step of discarding said storage means.

21. The method recited in claim 19, wherein said support structure is a substantially planar throwaway structure and has an area of extent at least substantially coextensive with said deflated sealed balloon, said rupture facilitating means including a plate member swingable attached to said support structure and a rotatable into said recess, said step of manipulating said rupture facilitating means comprising the step of swinging said plate from one position to another position.

22. The method recited in claim 18 wherein said support structure includes a first planar piece and a second planar piece hingedly secured to one another along respective edges, said recess taking the form of a first opening in said first planar piece and a second opening in said second planar piece, said first and said second opening being substantially coextensive and aligned with one another in a folded configuration of said first planar piece and said second planar piece, said plate member being attached to one of said first planar piece and said second planar piece along an edge of one of said first opening and said second opening, said step of swinging said plate towards and at least partially into said one of said first opening and said second opening.

* * * * *